US006950530B2

(12) United States Patent
Baird et al.

(10) Patent No.: US 6,950,530 B2
(45) Date of Patent: Sep. 27, 2005

(54) DIRECTIONAL LOUDSPEAKER UNIT

(75) Inventors: Jason Baird, London (GB); William T. Webb, London (GB)

(73) Assignee: Martin Audio Limited, High Wycombe (GB)

( * ) Notice: Subject to any disclaimer, the term of this patent is extended or adjusted under 35 U.S.C. 154(b) by 168 days.

(21) Appl. No.: 10/353,559

(22) Filed: Jan. 29, 2003

(65) Prior Publication Data

US 2003/0219139 A1 Nov. 27, 2003

(30) Foreign Application Priority Data

Jan. 31, 2002 (GB) ..... 0202284

(51) Int. Cl.[7] ..... H04R 1/02
(52) U.S. Cl. ..... 381/343; 381/340
(58) Field of Search ..... 381/337, 338, 381/339, 340, 343; 181/148, 152, 177, 181, 182, 187, 192

(56) References Cited

U.S. PATENT DOCUMENTS

| | | | | |
|---|---|---|---|---|
| 4,158,400 A | | 6/1979 | Vice | |
| 4,635,749 A | | 1/1987 | Tattersall | |
| 4,718,517 A | | 1/1988 | Carlson | |
| 4,836,327 A | | 6/1989 | Andrews et al. | |
| 5,602,930 A | | 2/1997 | Walton | |
| 5,778,084 A | | 7/1998 | Kling et al. | |
| 6,574,344 B1 | * | 6/2003 | Wiener et al. | 381/343 |
| 6,628,796 B2 | * | 9/2003 | Adamson | 381/342 |

FOREIGN PATENT DOCUMENTS

| | | |
|---|---|---|
| GB | 275571 | 7/1928 |
| GB | 448189 | 6/1936 |
| GB | 1494672 | 12/1977 |
| GB | 2211377 | 6/1989 |
| GB | 2226214 | 6/1990 |
| GB | 2309614 | 7/1997 |
| WO | WO 83/00977 | 3/1983 |
| WO | PCT/US00/06000 | 9/2000 |

* cited by examiner

*Primary Examiner*—Curtis Kuntz
*Assistant Examiner*—Brian Ensey
(74) *Attorney, Agent, or Firm*—Hodgson Russ LLP

(57) ABSTRACT

A directional loudspeaker unit for reproducing mid-range audio frequencies, comprising a cone loudspeaker and, disposed forwardly of the surface of the cone of the loudspeaker, a phase plug and a horn, wherein the phase plug and preferably also the horn are arranged co-axially on the axis of the cone, and wherein the phase plug has a central aperture. Preferably the horn has a diffraction slot defined by lateral walls which converge from the entrance (throat) of the horn.

18 Claims, 4 Drawing Sheets

SECTION ON A'–A''

SECTION ON A'–A''

DIRECTIONAL LOUDSPEAKER UNIT

BACKGROUND OF THE INVENTION

This invention relates to a directional loudspeaker unit, and more particularly to a loudspeaker unit having a horn with an acoustic output having a substantially phase-coherent radiating wavefront.

Adding a horn to a loudspeaker increases acoustic output of an associated driver unit in non-uniform manner, by causing the maxima (greatest value) of acoustic output to occur typically in the lower octaves of the operating band (the operating band is also referred to as the "passband"). The position of the maxima with respect to frequency is determined by the geometry of the horn, primarily the mouth area and depth of the horn. As the frequency increases from the frequency associated with the maxima in acoustic output, the output of a loudspeaker with a horn tends toward that of a loudspeaker without a horn. Transition smoothness of acoustic output as frequency increases from the frequency associated with the maxima depends on horn geometry, and primarily on the contour of the horn walls.

The shape of the horn walls, mouth area and horn depth also determine how acoustic output from the horn radiates into free space. If the acoustic radiation into free space up to a specific angle from the central axis of the horn in a particular (e.g. horizontal) plane is consistent over a frequency range of the horn, the horn is said to have a "constant directivity" in that plane. A known way of obtaining more nearly constant directivity in the upper frequencies of the passband is to have a width of the horn narrow from a throat width to a particular dimension related to the wavelength of the upper frequencies. Here, the term "throat" refers to the junction between the driver and the horn mounted on the driver. The plane perpendicular to the horn axis at the narrowed width of the horn is termed the "diffraction slot".

SUMMARY OF THE INVENTION

Even with a horn having a diffraction slot, however, it is difficult to attain constant directivity when the driven frequency approaches the upper end of the passband. Preferred embodiments of the present invention address this problem by adding a toroid or other centrally-apertured phase plug of defined cross-section which is mounted at the interface between the driver cone and the throat of the horn. Adding the apertured phase plug substantially eliminates the tendency of the output of the horn to fall to that of the unloaded driver as frequencies approach the upper end of the passband of the horn.

The invention is a directional loudspeaker unit for reproducing mid-range audio frequencies, for example, of the order of about 200 Hz to about 2.5 KHz or perhaps 3.5 KHz, the loudspeaker unit including a cone loudspeaker and, disposed forwardly of the surface of the cone of the loudspeaker, a phase plug and a horn, wherein the phase plug is arranged co-axially on the axis of the cone, and has a central aperture.

This arrangement has the advantage that the central aperture of the phase plug permits high-frequency mid-range sounds to pass directly to the horn from the centre of the cone loudspeaker.

Usually the horn also is co-axial with the cone and the phase plug, but it is possible also to use a horn with a curved axis.

Preferably the horn has a pair of opposite walls that converge with distance from the cone.

There may be a diffraction slot forwardly of the phase plug; preferably the pair of opposite walls converge to define the diffraction slot.

Preferably, the phase plug in of a generally toroidal, eg. doughnut, shape; for instance, it may have a part-spherical or part-ellipsoidal external shape.

Also preferably the entrance (throat) of the horn is substantially the same size and shape as the face of the cone.

If circular, the cone of the loudspeaker unit may have a nominal diameter of between approximately 165 mm (6.5 inches) and approximately 300 mm (12 inches). Other cone shapes eg. elliptical may alternatively be used.

When the loudspeaker unit is installed for use, the pair of opposite walls are preferably lateral walls of the horn. More preferably, the loudspeaker unit is housed in combination with a further such unit in a modular housing such that when a plurality of the housings are stacked one upon the other the loudspeaker units of the stacked housings form an equally-spaced vertical array. Even more preferably, the loudspeaker unit is housed in combination with at least one high-frequency loudspeaker unit, and a low-frequency loudspeaker unit.

A loudspeaker unit may be combined with another such loudspeaker unit such that the two units are adjacent and the horn of each unit is formed as a single horn common to both units. More preferably, the two units are in a housing that is configured to allow vertical stacking.

A plurality of high-frequency loudspeaker units may be disposed such that when a plurality of the modular housings are stacked one upon the other the high-frequency units of the stacked housings form an equally-spaced vertical array.

The invention also provides a loudspeaker unit that includes; a cone loudspeaker in which the cone vibrates non-uniformly such that as the frequency of sound increases that sound is produced by a reducing central area of the cone; a horn positioned axially to extend forwardly of the cone and having a pair of opposite walls that converge with distance from the cone; and, a centrally-apertured phase plug positioned to extend between the cone and horn and co-axially with the horn.

The horn may be configured such that the pair of converging opposite walls extend generally vertical when the loudspeaker unit is in use. More preferably, the horn includes a pair of diverging opposite walls each connected to an outer end of a respective one of the converging opposite walls.

We have discovered that the preferred form of the invention, in which a centrally apertured phase plug is disposed in front of a cone loudspeaker having a connected horn with a diffraction slot, improves the passband over which constant directivity is attainable by extending the useful frequency range of the upper end of the passband. A phase plug having a generally toroidal shape and placed so as to extend coaxial with the horn has shown the best results, although phase plugs having other shapes have also been shown to give improved results. The improvement over horn-loaded cones without phase plugs is believed to result from the phase plugs causing acoustic output from the cone at all frequencies to radiate over substantially the same path length from any point on the exposed diaphragm to the plane of the horn diffraction slot. This effect is coupled with the fact that the phase plug is being used with a cone loudspeaker, in which the cone vibrates non-uniformly with frequency; acoustic radiation varies over the surface of the cone, generally with higher frequencies being radiated from a progressively smaller circular area centred about the radiating axis. The shape of the phase plug is determined by the profile of the annular aperture defined by the outside of the plug and the profile of the circular aperture defined by the inside of the plug.

There are further considerations related to the shape of the phase plug. In order to produce a substantially phase-coherent, e.g. fairly flat, wavefront over the passband, diffraction of sound waves caused by sharp discontinuities in the area of the annular and central channels must be minimised. Diffraction affects the direction of wave propagation and is highly detrimental to the creation of a phase-coherent wave shape. Diffraction effects tend to be more prominent as frequency increases. The radii on the front of the phase plug must therefore be chosen to minimise diffraction effects and at the same time yield a phase-coherent wavefront shape.

At the lower end of the passband the volume of air passing in and out of the channels in the phase plug is sufficient to cause turbulence if the motion of that air is subject to the aforementioned sharp discontinuities in area. A compromise must therefore be struck between having a sufficiently-low rate of area change and achieving a correct physical shape for providing the phase-coherent wavefront. As the input signal to the driver is increased, the volume of air moving to and fro also increases. The radii on the rear profile of the phase plug serve to reduce turbulence, and to therefore increase the linear range of acoustic output. The radii on the front of the phase plug also play a role in reducing turbulence, although less so than the radii on the rear of the plug.

The diverging regions in between the front and rear radii of the plug are given profiles that generate both the correct path length and change in area required to produce a phase-coherent wavefront at the plane of the forward tip of the annular plug. The front and rear radii differ in shape due to the differences in acoustic radiation at the areas of the cone to which they are coupled.

An additional factor in increasing, at the upper end of the passband, the acoustic output of the loudspeaker unit is the distance between the rearmost point of the phase plug and the cone. This region forms a low-pass filter caused by the compliance of the air trapped within that region. The smaller the volume of air, and hence the smaller the distance, the higher the frequency at which this filtering effect occurs. A compromise exists between the one factor of allowing enough clearance for the cone to move freely and the other factor of the low-pass filtering effect. The distance must be sufficient to increase the low-pass filter frequency to a value above the highest frequency of the operation of the loudspeaker unit. The size and shape of this region is a consequence of the above-discussed profile and rear radii of the phase plug.

The phenomenon of diffraction is exploited at the diffraction slot of the horn. A highly-curved wave shape in the horizontal plane is produced, and by careful design of the horn walls located forward of the diffraction slot, sound is dispersed evenly across the whole passband, particularly at the upper frequencies of the passband over a given coverage angle.

As well as counteracting the tendency of the output of the horn to fall as the driven frequency approaches the upper end of the passband of the horn, it has been found that the preferred embodiments of the loudspeaker unit of the invention can have an output that is incrementally raised over the whole passband so as to be substantially equal to the output at the maxima described above. The constant directivity is substantially attained, with the consistency of acoustic radiation over the passband of the system at a given angle from the horn axis being improved over the output of a system outside the invention.

Preferred features of the present invention will now be described, by way of example only, with reference to the accompanying drawings, in which:

DETAILED DESCRIPTION OF THE INVENTION

Figure 1:
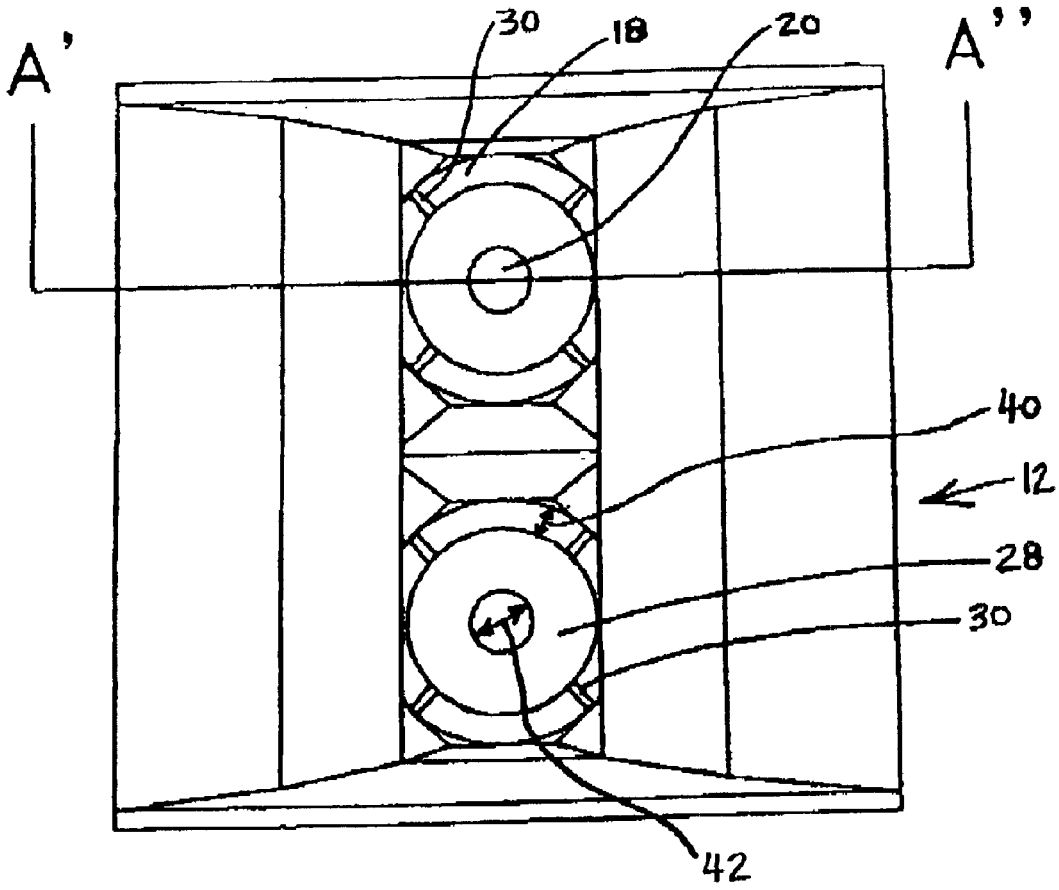
FIG. 1 is a front view of a loudspeaker assembly of two loudspeaker units of a first preferred embodiment, the loudspeaker units having their horns defined by a single housing.
Figure 2:
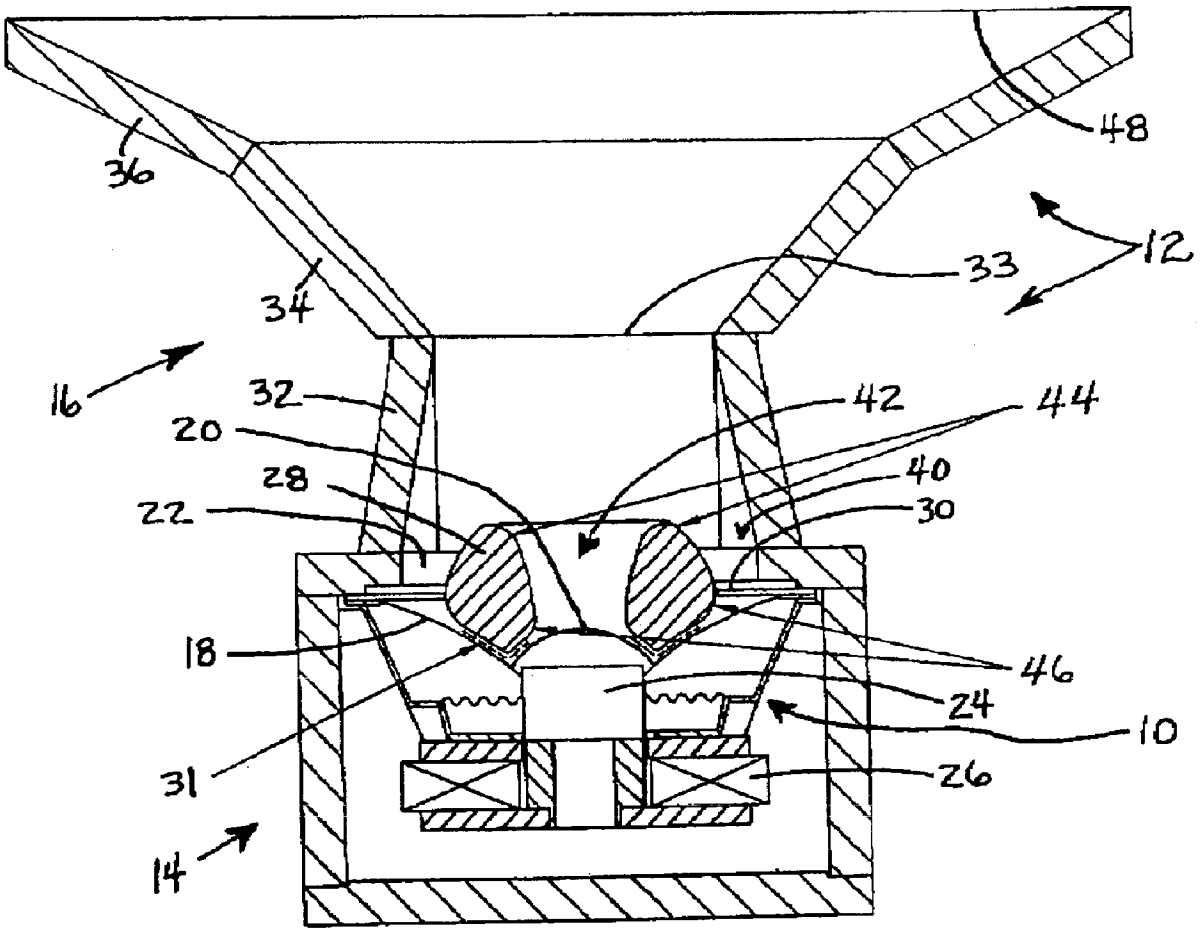
FIG. 2 is a cross-sectional view of the loudspeaker assembly of FIG. 1, the view being taken along the line A'–A" in FIG. 1.

As shown in FIGS. 1 and 2, in the first embodiment a pair of cone loudspeakers generally designated 10 are mounted within a housing generally designated 12. The housing 12 has a rectangular box portion 14 and an integral rectangular horn portion 16 common to both speakers 10. The pair of cone loudspeakers 10 are mounted in tandem on a front side of the rectangular box portion 14 such that the respective cone 18 and centred dust dome 20 of each loudspeaker face outwardly through an aperture 22 forming the mouth (throat) of the horn 16. As can be seen from FIGS. 1 and 2 together, the aperture 22 is approximately circular, and substantially equal in diameter to the circular cone 18. As shown in the cross-sectional view of FIG. 2, each cone 18 is connected to a former 24 which oscillates at the frequency of a signal being applied to a magnetic coil 26.

In front of each cone 18 a generally-toroidal phase plug 28 is mounted by webbed support members 30 to sit in the plane of the aperture 22; this aperture is at the previously-mentioned "throat" between cone and horn. As shown in FIG. 2, a back end of each phase plug 28 extends close to, but does not touch, the respective cone 18; the separation 31 is such that they do not come into contact when the cone 18 is vibrating. The phase plug 28 is shaped to provide an annular passage 40 and a diverging central passage 42 of circular section at the respective outside and inside of phase plug 28 so as to produce an optimized acoustic output. The exact shape of the passages 40, 42 is best determined in each particular case by using known methods of experimentation or computer modelling; that involves consideration of the factors discussed previously, and includes selection of appropriate values for the front radii 44 and the rear radii 46 of the phase plug 28.

The rectangular horn portion 16 of the housing 12 extends integrally from the front side of the rectangular box portion 14. Horn portion 16 has a converging portion 32 that converges in the plane of the cross-section to a diffraction slot 33, and two diverging portions 34 and 36 both of which diverge in that plane. As shown in FIG. 1, there is only a slight divergence in a vertical plane extending through the two loudspeakers and normal to the plane shown in FIG. 2; this divergence is only present because of practical considerations related to housing the loudspeaker units. The top and bottom surfaces of the horn diverge steadily, in this case at about 7° included angle.

In operation of this loudspeaker unit, low-frequency sound passes through the annular area 40 and the circular area 42, while high-frequency sound passes mostly through the circular area 42 alone. The resulting acoustic output is one that attains a generally constant directivity at the horn mouth 48 for both low-frequency and high-frequency sound.

Figure 3:
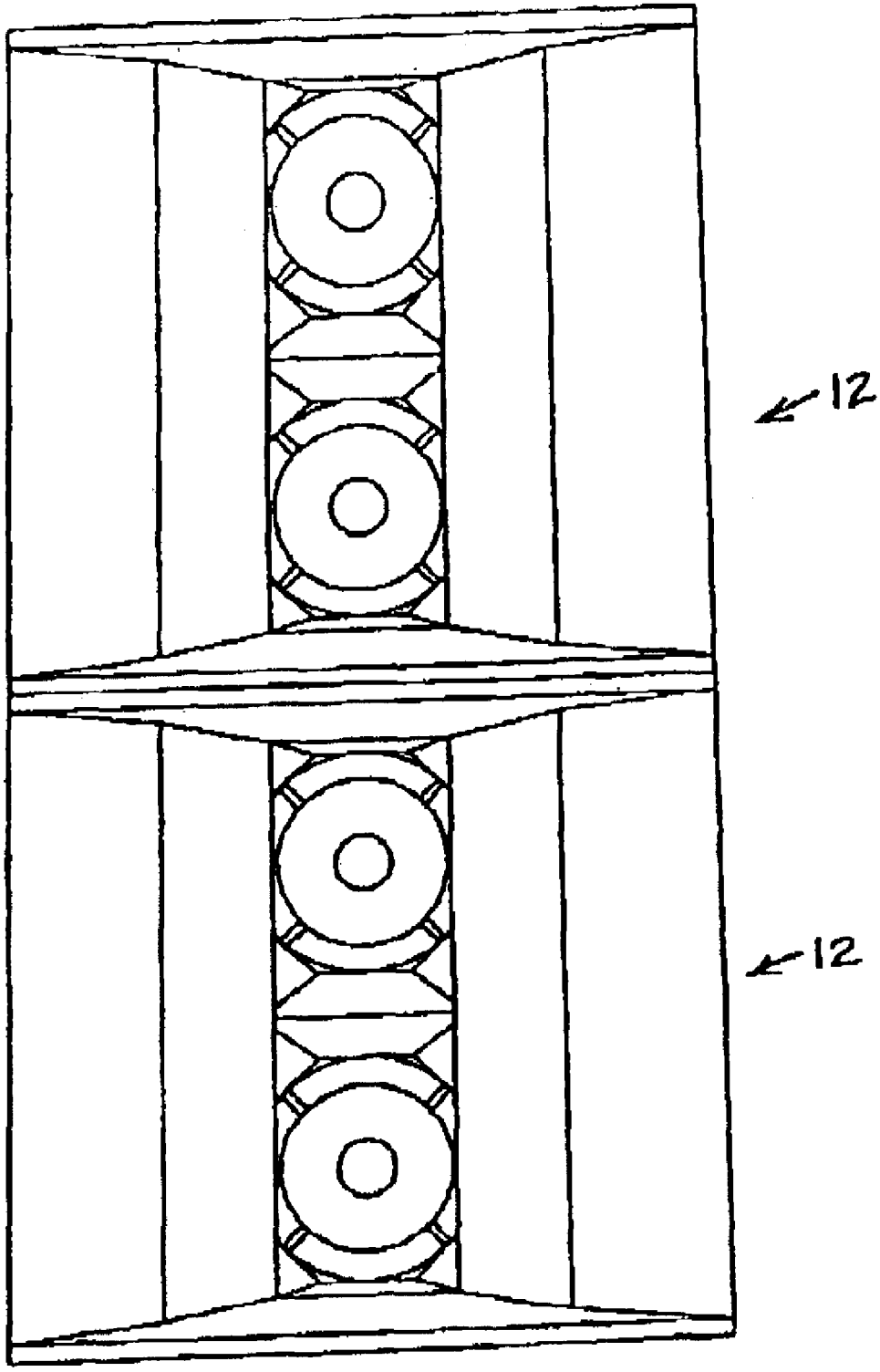
FIG. 3 is a front view of two stacked loudspeaker assemblies of FIG. 1, the assemblies being stacked one upon the other to form a vertical loudspeaker array.

FIG. 3 shows two of the loudspeaker assemblies of FIG. 1 stacked such that four of the loudspeaker units are in a vertical array.

Figure 4:
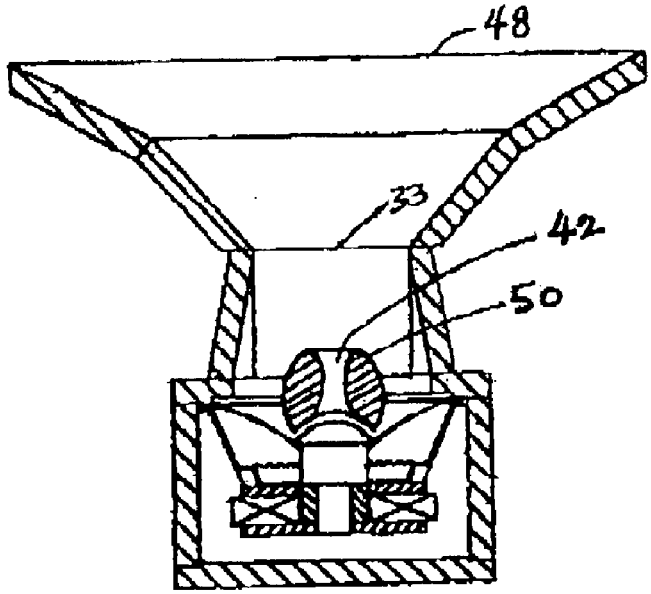
FIG. 4 is a cross-sectional view of a second preferred embodiment of the loudspeaker unit of the invention, the phase plug having a partial spheroidal external shape; and, FIG. 5 is a cross-sectional view of a third preferred embodiment of the loudspeaker unit of the invention, the phase plug having a partial ellipsoidal external shape.
Figure 5:
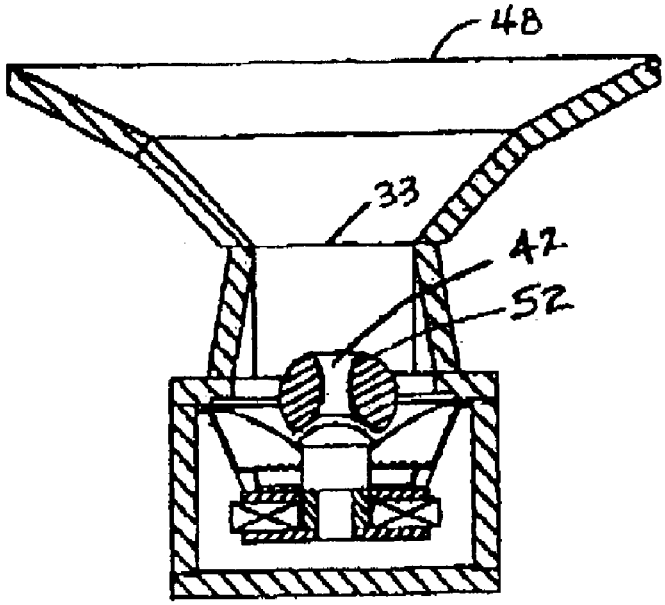

FIGS. 4 and 5 illustrate respective second and third preferred embodiments of the invention in which toroidal phase plug 28 of the first preferred embodiment is replaced respectively by a toroidal phase plug 50 having a generally partial-spherical external shape, and a toroidal phase plug 52 having a generally partial-ellipsoidal external shape; the plugs 50 and 52 could more properly be referred to as having front, and more preferably also rear, surfaces formed as crescents of revolution about the axis of the speaker cone. Each has a central passage 42 as in the FIG. 2 embodiment. Although the results from using the phase plugs 50 and 52 have not been as good as with the empirically-designed phase plug of FIG. 2, they nevertheless have provided an improvement over existing loudspeaker units with respect to attaining constant directivity for sounds at the top end of the mid-range of audio frequencies.

While the present invention has been described in its preferred embodiment, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

The text of the abstract filed herewith is repeated here as part of the specification.

A directional loudspeaker unit for reproducing mid-range audio frequencies, comprising a cone loudspeaker and, disposed forwardly of the surface of the cone of the loudspeaker, a phase plug and a horn, wherein the phase plug and preferably also the horn are arranged co-axially on the axis of the cone, and wherein the phase plug has a central aperture. Preferably the horn has a diffraction slot defined by lateral walls which converge from the entrance (throat) of the horn.

What is claimed is:

1. A directional loudspeaker unit for reproducing mid-range audio frequencies, comprising a cone loudspeaker and, disposed forwardly of the surface of the cone of the loudspeaker, a phase plug and a horn, wherein the phase plug is arranged co-axially on the axis of the cone and has a generally toroidal shape, the phase plug having a central aperture and forming with the horn an annular aperture, the central aperture forming a first sound path predominantly carrying high-frequency sound from a central portion of the cone and the annular aperture forming a second sound path of different shape to the first said path and predominantly carrying low-frequency sound from a surrounding annular portion of the cone, the central and annular portions of the cone being driven by a single driving means, the separation of the sound according to frequency and path shape in the respective first and second sound paths being such that a generally constant directivity is attained by sound leaving the mouth of the horn.

2. A directional loudspeaker unit for reproducing mid-range audio frequencies, comprising a cone loudspeaker and, disposed forwardly of the surface of the cone of the loudspeaker, a phase plug and a horn, wherein the phase plug has a generally toroidal shape and is arranged co-axially on the axis of the cone and has a rear surface in close proximity to the cone, the phase plug having a central aperture and forming with the horn an annular aperture, predominantly high-frequency sound produced by movement of a central portion of the cone being separated by the presence of the phase plug from predominantly low-frequency sound produced by movement of a surrounding annular portion of the cone, the central and annular portions of the cone being driven by a single driving means, the high-frequency sound and low-frequency sound merging downstream of the phase plug such that sound of a generally constant directivity is attained at the mouth of the horn.

3. A loudspeaker unit as claimed in claim 1, wherein the phase plug has a generally partial-spherical shape.

4. A loudspeaker unit as claimed in claim 2, wherein the phase plug has a generally partial-spherical shape.

5. A loudspeaker unit as claimed in claim 1, wherein the phase plug has a generally partial-ellipsoidal shape.

6. A loudspeaker unit as claimed in claim 2, wherein the phase plug has a generally partial-ellipsoidal shape.

7. A loudspeaker unit as claimed in claim 1, wherein the inner entrance to the horn is of substantially the same size and shape as the face of the cone.

8. A loudspeaker unit as claimed in claim 2, wherein the inner entrance to the horn is of substantially the same size and shape as the face of the cone.

9. A loudspeaker unit as claimed in claim 1, wherein the horn has a pair of opposite walls that converge with distance from the cone.

10. A loudspeaker unit as claimed in claim 9, wherein the pair of opposite walls converge to define a diffraction slot forwardly of the phase plug.

11. A loudspeaker unit as claimed in claim 10, the unit being configured such that, when the loudspeaker unit is installed for use, the pair of opposite walls are lateral walls of the horn.

12. A loudspeaker unit as claimed in claim 11, in combination with a further said unit, wherein the two units are adjacent and the horn of each unit is formed as a single horn common to both units.

13. A loudspeaker unit as claimed in claim 12, wherein the two units are in a housing that is configured to allow vertical stacking.

14. A loudspeaker unit as claimed in claim 12, wherein the horn has a pair of opposite walls that converge with distance from the cone.

15. A loudspeaker unit as claimed in claim 14, wherein the pair of opposite walls converge to define a diffraction slot forwardly of the phase plug.

16. A loudspeaker unit as claimed in claim 15, the unit being configured such that, when the loudspeaker unit is installed for use, the pair of opposite walls are lateral walls of the horn.

17. A loudspeaker unit as claimed in claim 16, in combination with a further said unit, wherein the two units are adjacent and the horn of each unit is formed as a single horn common to both units.

18. A loudspeaker unit as claimed in claim 17, wherein the two units are in a housing that is configured to allow vertical stacking.

* * * * *